US006811049B2

(12) United States Patent
Lukacevic

(10) Patent No.: US 6,811,049 B2
(45) **Date of Patent: *Nov. 2, 2004**

(54) SPLASH-PROOF LID ASSEMBLY

(76) Inventor: Temo Lukacevic, 268 W. 72nd St., New York, NY (US) 10023

( * ) Notice: Subject to any disclaimer, the term of this patent is extended or adjusted under 35 U.S.C. 154(b) by 0 days.

This patent is subject to a terminal disclaimer.

(21) Appl. No.: 10/083,848

(22) Filed: Feb. 26, 2002

(65) Prior Publication Data

US 2002/0079314 A1 Jun. 27, 2002

Related U.S. Application Data

(63) Continuation-in-part of application No. 09/957,327, filed on Sep. 20, 2001, now Pat. No. 6,533,139, which is a continuation-in-part of application No. 09/545,159, filed on Apr. 7, 2000, now Pat. No. 6,296,141, which is a continuation-in-part of application No. 09/095,419, filed on Jun. 8, 1998, now abandoned.

(51) Int. Cl.[7] ..... A47G 19/22; B65D 51/18

(52) U.S. Cl. ..... 220/254.3; 220/254.4; 220/254.7; 220/713; 220/719

(58) Field of Search ..... 220/254.3, 254.4, 220/254.7, 254.8, 254.6, 253, 254.1, 501, 521, 713, 703, 711, 718, 717, 719, 714

(56) References Cited

U.S. PATENT DOCUMENTS

| | | | | | |
|---|---|---|---|---|---|
| 4,322,014 | A | * | 3/1982 | Philip | 220/713 |
| 4,331,255 | A | * | 5/1982 | Fournier | 220/257.2 |
| 4,394,928 | A | * | 7/1983 | Philip | 220/373 |
| 4,767,019 | A | * | 8/1988 | Horner | 220/713 |
| 6,176,384 | B1 | * | 1/2001 | Voloshin | 220/253 |
| 6,216,904 | B1 | * | 4/2001 | Cagan | 220/253 |
| 6,296,141 | B1 | * | 10/2001 | Lukacevic | 220/713 |
| 6,305,571 | B1 | * | 10/2001 | Chu | 220/719 |
| 6,325,236 | B1 | * | 12/2001 | Wong | 220/713 |
| 6,488,173 | B2 | * | 12/2002 | Milan | 220/713 |
| 6,533,139 | B2 | * | 3/2003 | Lukacevic | 220/719 |

* cited by examiner

*Primary Examiner*—Lee Young
*Assistant Examiner*—Niki M. Eloshway
(74) *Attorney, Agent, or Firm*—Muserlian, Lucas and Mercanti

(57) ABSTRACT

A splash-proof lid assembly is a substantially planar unit which is made up of a disc and a bottom section that is rotatably connected to the disc. By rotating the bottom section to the underside of the disc, a chamber is formed which allows for drinking from a cup once the lid is placed on the cup.

36 Claims, 10 Drawing Sheets

SPLASH-PROOF LID ASSEMBLY

CROSS-REFERENCE TO RELATED APPLICATIONS

This application is a continuation-in-part of U.S. patent application Ser. No. 09/957,327 filed Sep. 20, 2001, now U.S. Pat. No. 6,533,139 issued Mar. 18, 2003, which in turn is a continuation-in-part of U.S. patent application Ser. No. 09/545,159 filed Apr. 7, 2000, now U.S. Pat. No. 6,296,141 issued Oct. 2, 2001, which was in turn, a continuation-in-part of patent application Ser. No. 09/095,419 filed Jun. 8, 1998, now abandoned.

BACKGROUND OF THE INVENTION

1. Field of the Invention

This invention relates to a removable lid for a cup and, more particularly, to a lid assembly which is used to form the lid. The lid of the present invention is especially suited for disposable coffee cups and drinking cups. The lid assembly of the present invention avoids inadvertent splashing which occurs due to movement of the cup.

2. Art Related to the Invention

Splash-proof lids for drinking cups are known. Typically, they comprise a round, removable cover which fits tightly over the top opening of a cup to prevent unwanted spillage of the contents of the cup while allowing the user to drink the contents of the cup even though the lid remains on the cup. To allow the user to drink the contents of the cup while the lid remains on the cup, both a drinking hole and an air hole are provided in the lid. Both holes are configured to prevent unwanted loss or spillage of the contents of the cup which occurs when the cup is unintentionally moved. Typically, such lids are used on disposable cups which the user takes on a train, a plane, in a boat, or in a car.

The drinking hole is usually positioned at the edge of the lid next to the side wall of the cup, while the air hole is positioned either centrally in the lid or along the edge of the lid next to the side wall of the cup, opposite the drinking hole.

One of the problems in the prior art is that various lid assemblies tend not to be completely splash-proof. There is a need to invent a cup which is simple in design but yet splash-proof. Furthermore, there is a need to provide a simple design which can be employed with disposable cups.

SUMMARY OF THE INVENTION

A simple lid assembly for making a splash-proof lid for a cup has now been discovered. The lid is intended to be disposable and for use with disposable drinking cups such as the type used for coffee, tea, etc. The lid has an air hole which is centrally located in the lid and a drinking hole which is located along the periphery of the lid. The lid is especially designed to avoid spillage of the contents of the cup through the drinking hole and the air hole.

It has been discovered that the jiggling or unintended movement of the cup causes a wave to form on the surface of the liquid and to travel back and forth across the surface of the liquid crashing against the side walls of the cup. When the wave hits the side walls of the cup, it splashes out of the drinking hole or the air hole, when the air hole is positioned next to the side wall of the cup. Thus, it is the movement of the wave on the surface of the liquid in the cup and its crashing against the side walls of the cup that causes the splashing and the spillage of the liquid.

It has also been found that when the air hole is made small and positioned in the center of the lid that spillage or splashing due to the wave through the air hole does not occur. Furthermore, it has been found that if the air hole is made rather small compared to the drinking hole, that the air hole will still function to allow liquids to flow out of the drinking hole and air in through the air hole. Thus, in the present invention, the air hole is positioned in the center of the lid and made relatively small compared to the drinking hole. In other words, the drinking hole is much larger than the air hole.

To avoid spillage out of the drinking hole, a large expansion chamber is employed which is in fluid communication with the drinking hole and in fluid communication with the interior of the cup. The chamber has one or more inlets which are positioned in the bottom wall and/or the side wall of the chamber. The drinking hole is positioned in the top wall of the chamber. The drinking hole and the inlets of the chamber are not in vertical alignment with each other. Thus, when any portion of the wave comes through the inlets into the chamber, it does not go through the drinking hole, but rather, is redirected back into the cup or contained in the chamber. This prevents spillage of the contents of the cup through the drinking hole.

The chamber has a bottom portion which extends below the lid and down into the area which is formed by the cup. The top portion of the chamber can be either coplanar with the top surface of the lid or extend above the top surface of the lid.

Preferably, the chamber has an arched or crescent shape, when viewed from above. The arched chamber preferably extends both above and below the planar surface of the lid. The drinking hole is positioned in the top wall of the chamber. The bottom chamber portion extends below the planar surface of the lid and preferably contains one or more inlets through which the contents of the cup travel to reach the drinking hole. The arched chamber follows the curvature of the lid, is centered on the drinking hole, and is in fluid communication with the drinking hole. The arched chamber is formed along the edge of the lid and has one or more inlets to allow the liquid contents of the cup to travel into the chamber. The inlets can be in the bottom wall of the chamber, in the end walls of the chamber, or the side walls of the chamber. The drinking hole is positioned in the top wall of the chamber to allow the liquid contents to flow from the cup through the chamber and into the user's mouth. The center line of the chamber (assuming the chamber is essentially cylindrical in cross section) follows a radial line from the center of the lid that is less than the radius of the lid and is concentric with the radius of the lid. The lid itself has an engaging periphery to allow it to engage the rim of the cup and become removably affixed to the rim of the cup. In this way, the lid of the present invention fits a conventional disposable cup and no special cup must be employed with the lid of the present invention.

It is preferred that the lid of the present invention be molded into a one-step molding process. For example, the lid assembly is suitably made by thermoforming. In this process, the lid is made up of two pieces, one piece which is a disc that makes up the majority of the lid and can generally be referred to as the top of the lid while the other piece is a bottom section which forms the bottom portion of the chamber. The bottom section of the lid can be rotatably connected to the disc or, alternatively, can be separate from the disc.

Broadly, the splash-proof lid assembly for making a splash-proof lid for a drinking cup in accordance with the present invention comprises:

a circular disc having a snap fitting periphery for engagement with a cup rim;

an air hole positioned in said disc at the center of said disc;

a drinking hole positioned in said disc adjacent said snap fitting periphery of said disc, said drinking hole being larger than said air hole;

a first engagement means positioned on said disc at the underside of said disc between said snap fitting periphery and said air hole;

a bottom lid section having an arcuate side which mates with a portion of said snap fitting periphery of said disc, and a second engagement means for engaging with said first engagement means when said arcuate side mates with said snap fitting periphery; and a chamber formed between said disc and said bottom lid section when said bottom lid section is placed against the underside of said disc and said first engagement means engages said second engagement means and said arcuate side mates with said portion of said snap fitting periphery, said chamber having a bottom chamber portion which is formed by said bottom lid section and extends below said disc, said chamber being centered on said drinking hole, said disc forming a top chamber portion, said chamber having one or more inlets formed in the bottom chamber portion and said inlet not being in vertical alignment with said drinking hole.

Preferably, said bottom lid section is rotatably attached to said disc along said snap fitting periphery of said disc and said arcuate side of said bottom lid section. Said bottom lid section can also be separate from said disc until said bottom section is mated with said disc.

Preferably, the top chamber portion, which is formed in said disc, extends upwardly from the planar surface of said disc, and is centered on said bottom chamber portion, said drinking hole being centered in said top chamber portion.

The inlets in the bottom chamber portion are preferably in the side walls, the end walls, or the bottom of said bottom chamber portion.

In one embodiment, the top portion of said chamber is flat and coplanar with said disc.

More preferably, the chamber has an arcuate shape which is concentric with the snap fitting periphery of said disc.

Broadly, the splash-proof lid for a drinking cup in accordance with the present invention comprises:

a circular disc having a snap fitting periphery for engagement with a cup rim;

an air hole in said disc which is positioned in the center enter of said disc;

an arched chamber adjacent said snap fitting periphery, said chamber having a center line which follows a radial line that is concentric with the radius of said disc and less than the radius of said disc, said chamber having a top portion which extends above the top surface of said disc and a bottom portion which extends below the bottom surface of said disc;

a drinking hole in a top wall of said chamber, said chamber centered on said drinking hole, said air hole being smaller than said drinking hole; and one or more inlets in said chamber positioned in said bottom portion of said chamber, such that said inlet is in fluid communication with said drinking hole to allow a user to drink through the lid when the lid is placed on top of a drinking cup.

Broadly, the splash-proof lid assembly for making a lid for a drinking cup in accordance with the present invention can be defined as comprising:

a circular disc having a periphery;

a first snap fitting periphery portion extending around a first portion of said periphery, said first snap fitting periphery portion absent from a second portion of said periphery;

a chamber top portion with a drinking hole therein, said chamber top portion positioned adjacent to said periphery at said second portion of said periphery, said chamber top portion rising above the top surface of said disc;

an air hole positioned in the center of said disc;

a bottom section having an arcuate side, said bottom section having a second snap fitting periphery portion adjacent said arcuate side, and a chamber bottom portion having one or more inlets therein, said chamber bottom portion adjacent said second snap fitting periphery portion, said bottom section rotatably attached to said disc along said periphery of said disc such that when said bottom section is rotated under said disc said second snap fitting periphery portion is positioned in said second portion of said periphery, said chamber bottom portion aligns with said chamber top portion to form an arched chamber in said lid, said one or more inlets are in fluid communication with said drinking hole, and said first snap fitting periphery portion and said second snap fitting periphery portion align for a complete snap fitting periphery of said lid.

Preferably, the arched chamber forms an angle of about 5° to about 90° with respect to the radius of the lid. More preferably, the arched chamber forms an angle of about 15° to about 75° and most preferably the angle is about 30° to about 60°.

The inlet may be any suitable shape. Most preferably the inlet is either circular or oval. It is most preferred to use two or more inlets in the chamber.

It is also preferred that the bottom wall of the chamber be inclined such that liquid in the chamber flows out of the chamber back into the cup through the inlets when the lid is horizontal.

BRIEF DESCRIPTION OF THE DRAWINGS

These and other aspects of the present invention may be more fully understood by reference to one or more of the following drawings wherein.

DETAILED DESCRIPTION OF THE INVENTION

Figure 1:
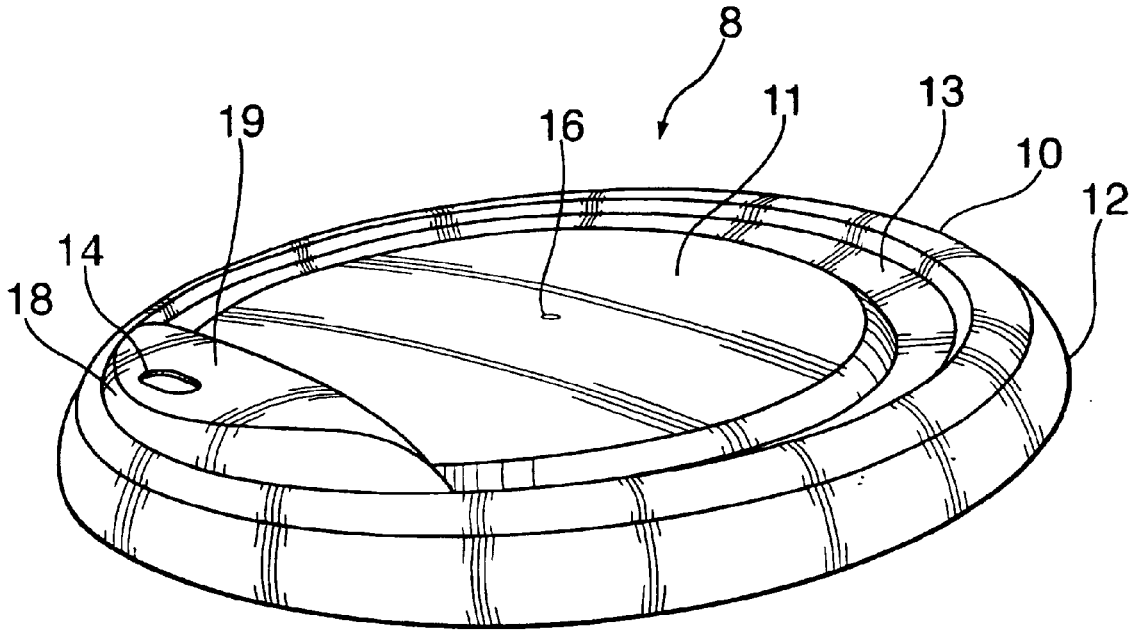
FIG. 1 is a perspective top view of the assembled lid of the present invention.

FIG. 1 illustrates a top perspective view of the assembled lid 8. Lid 8 comprises disc 10 having raised center section 11 on top thereof, snap fitting periphery 12 along the sides thereof, moat 13, drinking hole 14 and air hole 16 extending through, and chamber 18 illustrated as arch-shaped, has top portion 19 and drinking hole 14 extending therethrough. Top portion 19 rises above the surface of disc 10.

Figure 2:
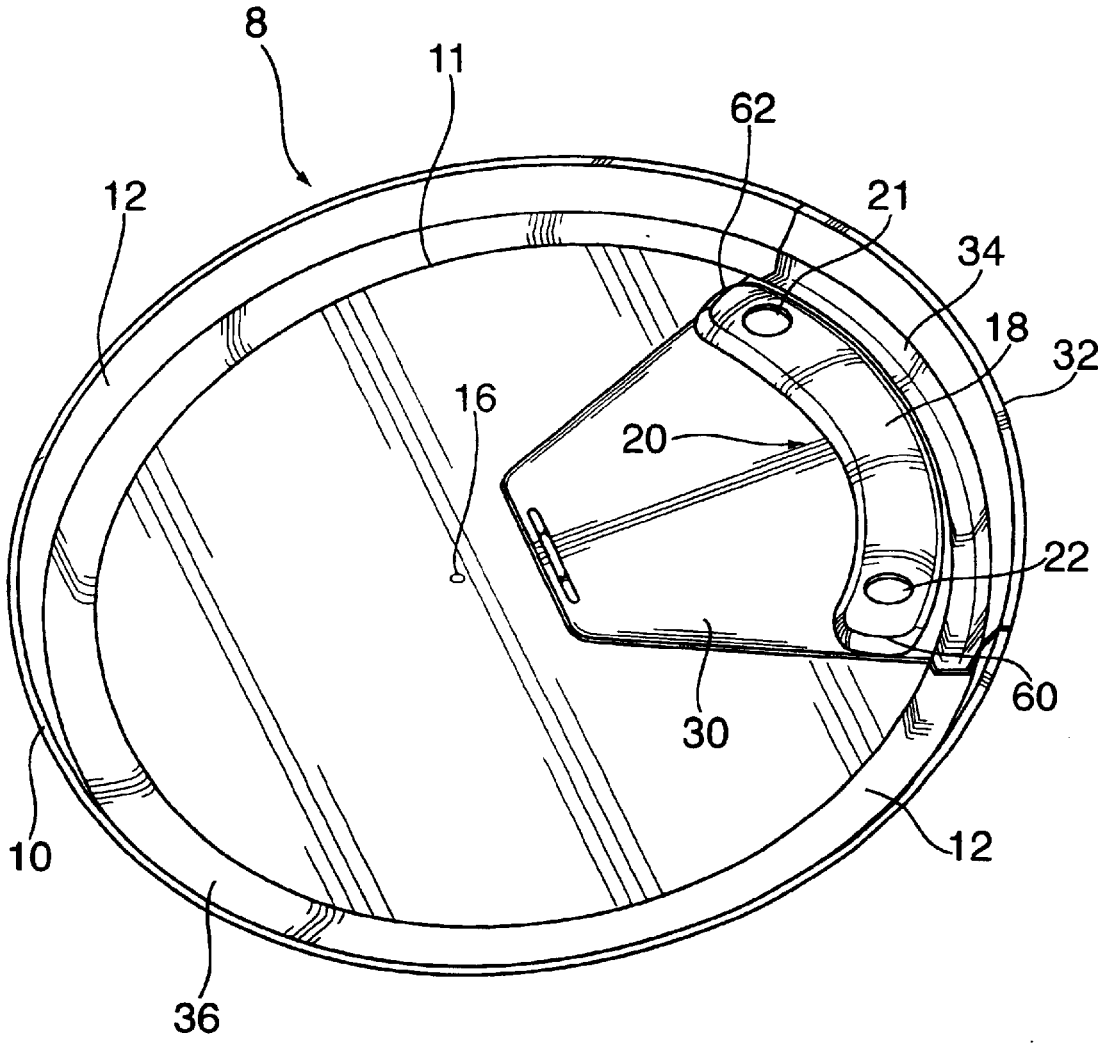
FIG. 2 is a perspective bottom view of the assembled lid of the present invention.

FIG. 2 is a perspective view of the bottom of lid 8. As shown in FIG. 2, bottom portion 20 of chamber 18 is sunken below the bottom surface of disc 10. Bottom portion 20 has two inlet openings 21 and 22. Chamber 18 is in fluid communication with drinking hole 14 such that when a user drinks from a cup, the liquid contents of the cup flow through inlet openings 21, 22 into chamber 18, through chamber 18 to drinking hole 14 and into the user's mouth.

Bottom section 30 is used to form chamber 18 and a portion of snap fitting periphery 12. Bottom section 30 comprises arched side 32 with snap fitting periphery portion 34. Disc 10 has snap fitting periphery 36. Snap fitting periphery portion 36 along with snap fitting periphery portion 34 makes up snap fitting periphery 12.

Lid 8 is securely held on a cup due to the engagement between snap fitting periphery portions 34, 36 and the rim of the cup. This engagement between snap fitting periphery portions 34 and 36 occur when the lid 8 is pressed down onto the rim of the cup. Such snap fitting periphery portions 34, 36 are conventional and well-known to those of skill in the art. The snap fitting periphery portions 34, 36 house the lip of the cup when the two are joined.

Figure 3:
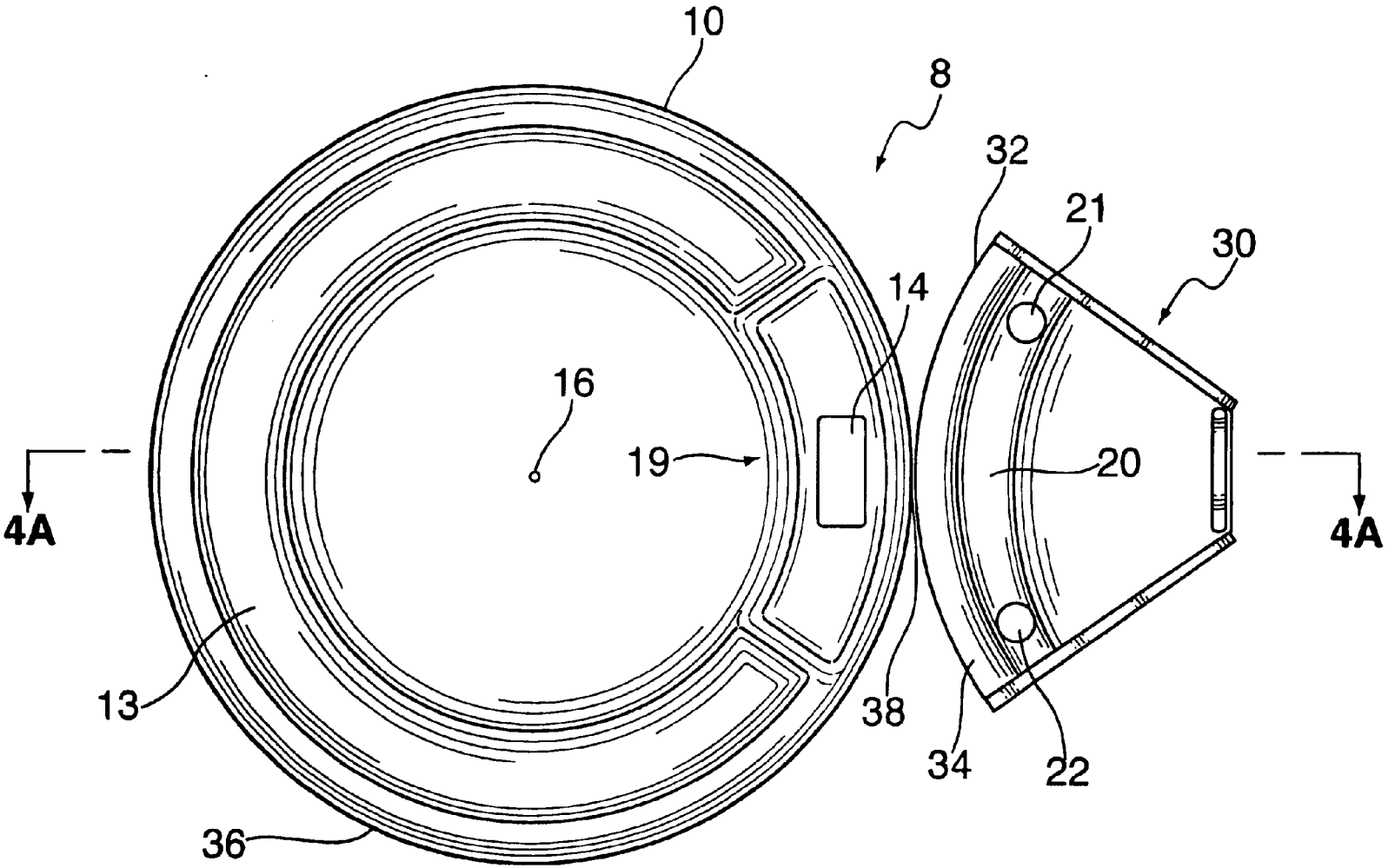
FIG. 3 is a top view of the lid assembly of the present invention.

As shown in FIG. 3, which is a top view of lid 8 unassembled into its two pieces, bottom section 30 and disc 10, bottom section 30 and disc 10 are connected along their respective peripheries at joint 38. Bottom section 30 has arched side 32 with snap fitting periphery portion 34. Bottom section 30 has bottom portion 20 which forms the bottom and a part of the lower side walls of chamber 18. Inlet openings 21, 22 are shown in the bottom wall of portion 20.

Figure 4A:
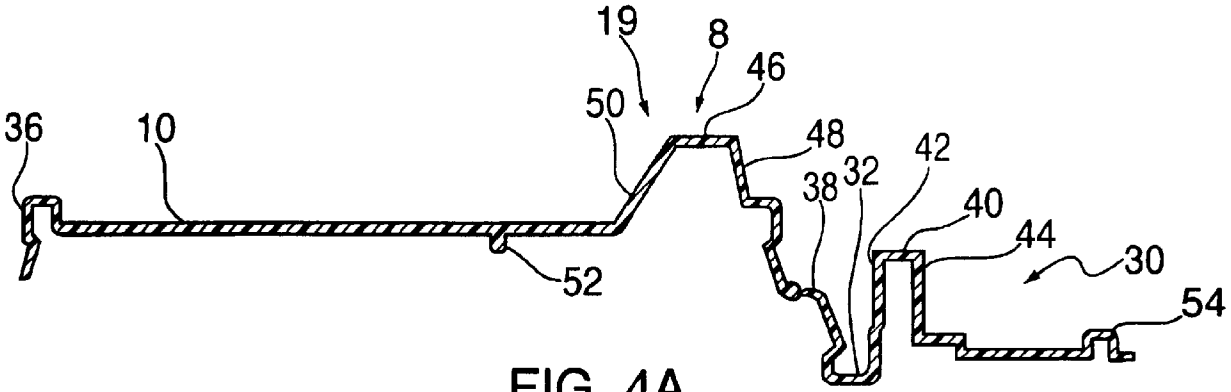
FIGS. 4A–4C are cross-sections of the lid assembly of the present invention along the lines 4A—4A of FIG. 3 and illustrate the assembly process in accordance with the present invention.
Figure 4B:
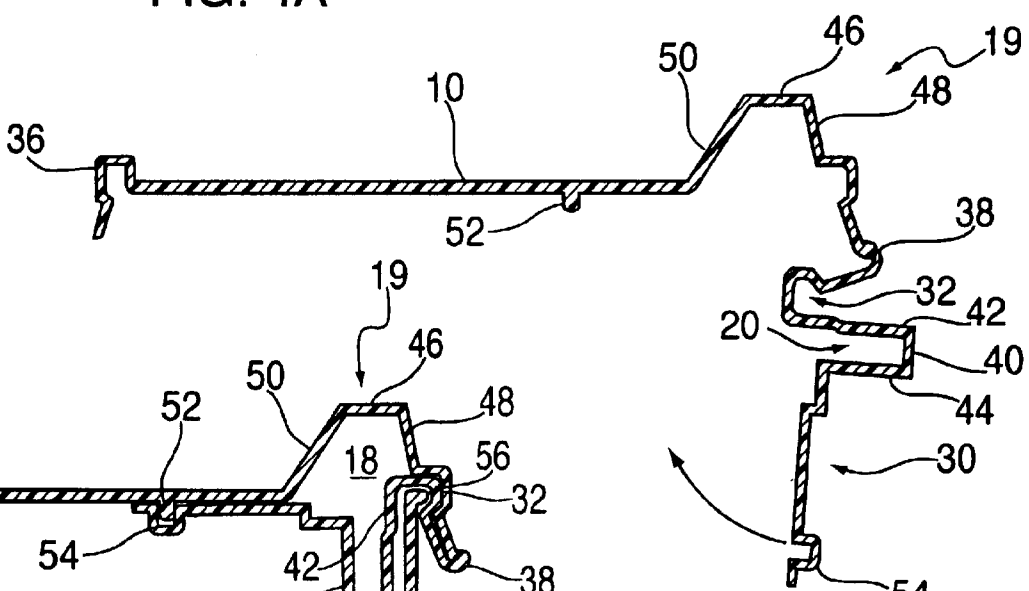
Figure 4C:
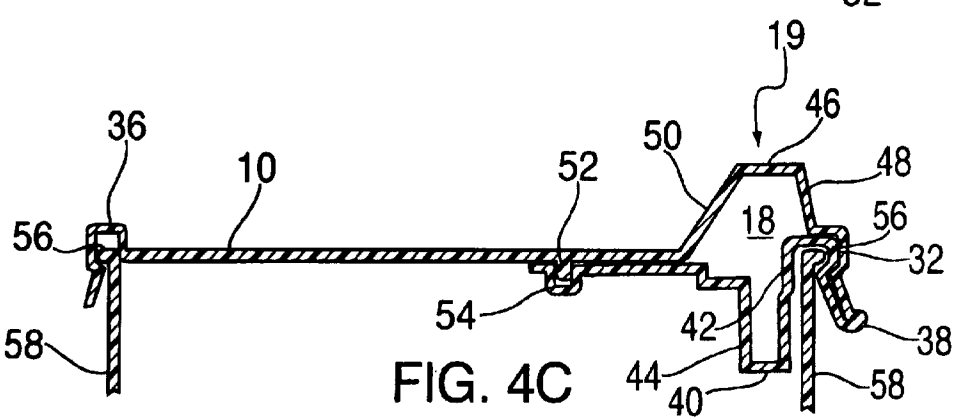

FIG. 4A illustrates a cross-section of unassembled lid 8 of the present invention. As shown therein, bottom section 30 is connected to disc 10 by joint 38. Joint 38 is a conventional weak spot which allows for the rotation of bottom section 30 under disc 10 as shown in FIGS. 4B and 4C.

Bottom portion 20 has bottom wall 40 and lower side walls 42 and 44. Top portion 19 has top wall 46 and upper side walls 48 and 50. When bottom section 30 is rotated around joint 38, bottom wall 40, top wall 46, lower side walls 42, 44 and upper side walls 48, 50 form chamber 18.

It is preferred that bottom section 30 is securely fixed to disc 10 by means of a latch mechanism which is illustrated as projection 52 and channel 54. In the embodiment shown in FIGS. 4A–4C, projection 52 is on the bottom side of disc 10 and channel 54 is on the bottom section 30. Alternatively, however, bottom section 30 could have the protrusion and disc 10 could contain the channel. It will be understood, however, that such a latching mechanism is not necessary because, when bottom section 30 is rotated about joint 38 so as to join bottom section 30 to the underside of disc 10, the force between the rim of the cup and snap fitting periphery portion 34 is enough to maintain the engagement between disc 10 and bottom section 30. It will be appreciated that the rim of the cup forces snap fitting periphery portion 34 up to and against disc 10 as shown in FIG. 4C. Rim 56 of cup 58 is illustrated in FIG. 4C.

It should be appreciated that although two inlets 21 and 22 are illustrated, additional inlets in chamber 18 may be employed. Specifically, there can be inlets in lower end walls 60 and 62 of chamber 18. Lower end walls 60 and 62 are illustrated in FIG. 2. Alternatively, one inlet may be used which may be in bottom portion 20 or lower end walls 60 or 62.

It will also be appreciated that although FIG. 3 illustrates that bottom section 30 is positioned directly opposite drinking hole 14, joint 38 can be at another location along the periphery of disc 10, provided that when section 30 is rotated about joint 38, bottom portion 20 aligns with top portion 19 to form chamber 18.

It will also be noted in FIGS. 4A–4C that disc 10 has no snap fitting periphery in the area in which snap fitting periphery portion 34 resides. Thus, disc 10 has no snap fitting periphery along a portion of its periphery, that portion being the portion which is filled by snap fitting periphery portion 34 upon rotation of bottom section 30 against disc 10.

Obviously, the dimensions of the lid assembly are adjusted accordingly depending on the size of the cup. Typically, disposable cups are made in different sizes, such as small, medium and large. The lid of the present invention will have its dimensions adjusted accordingly for each one of the cup dimensions.

The lid assembly of the present invention is made in any conventional plastic molding process wherein the lid assembly is molded in a simple molding operation in a conventional manner using conventional equipment.

It will be appreciated by those of skill in the art that lid 8 in the unassembled form, i.e. lid assembly as shown in FIGS. 3 and 4A, easily nest with one another. This is important for the purposes of shipping the lids to different users. As will be appreciated, the unassembled lid 8 takes up less volume than the assembled lid 8 as shown in FIGS. 1, 2 and 4C.

It will be appreciated that it is preferred that disc 10 employ moat 13 as shown in FIG. 1 so as to catch any liquid that may escape from drinking hole 14. This moat is not essential and need not be present in the invention as shown in FIGS. 4A–4C.

It will also be appreciated that the cross-sectional dimensions of chamber 18 may be rounded as shown in FIGS. 1 and 2, or may be rectangular in shape as shown in FIGS. 4A–4C.

Figure 4D:
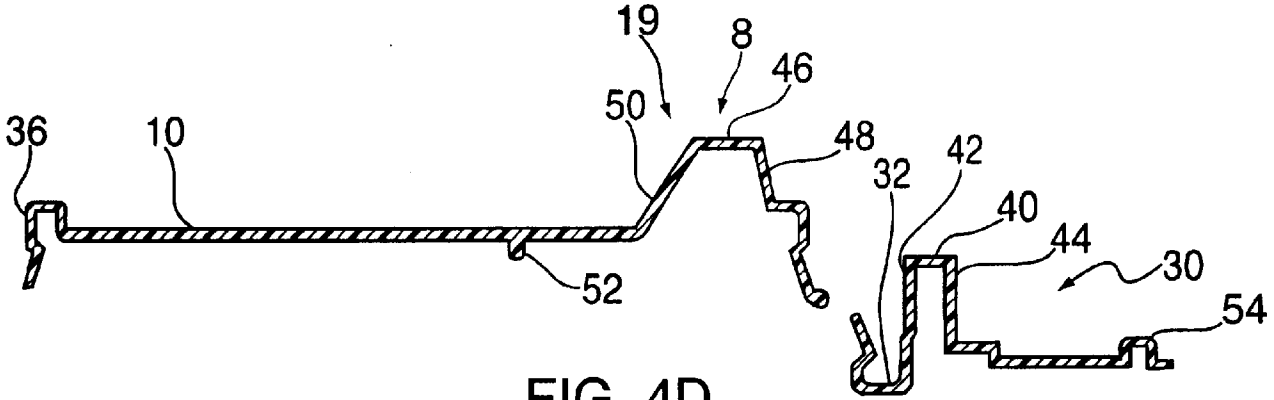
FIG. 4D illustrates another embodiment of the lid assembly of FIGS. 4A–4C.

In FIG. 4D, an identical lid assembly as shown in FIGS. 4A–4C is illustrated, except that in FIG. 4D bottom section 30 is not hinged to disc 10 by joint 38, hence, joint 38 is absent from FIG. 4D.

Figure 5A:
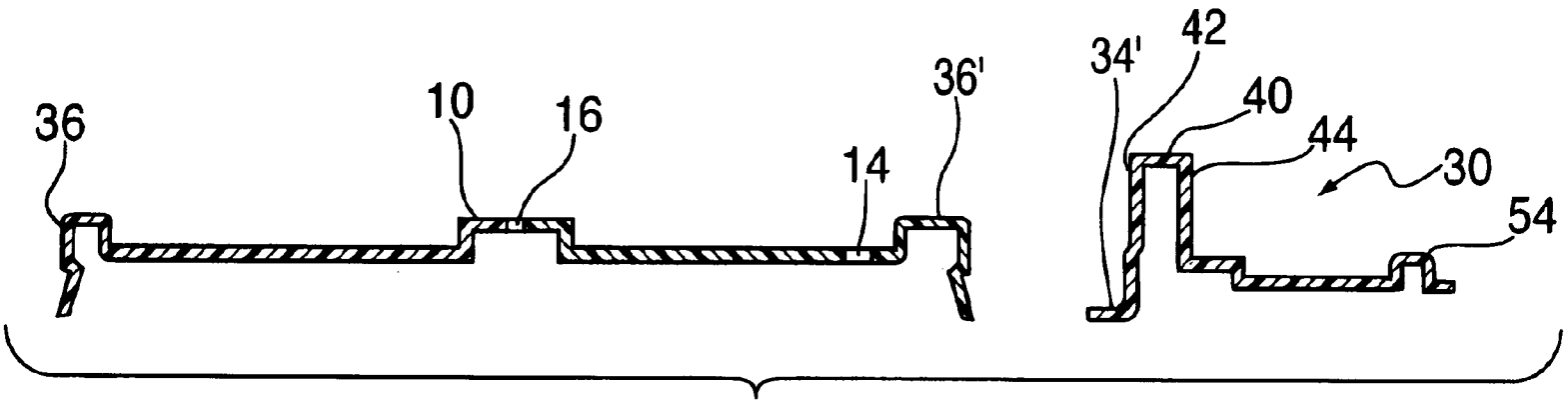
FIGS. 5A–5B are cross-sections of the lid assembly of the present invention wherein the chamber is primarily made up of the lower lid section and the lid and bottom portion are separate.
Figure 5B:
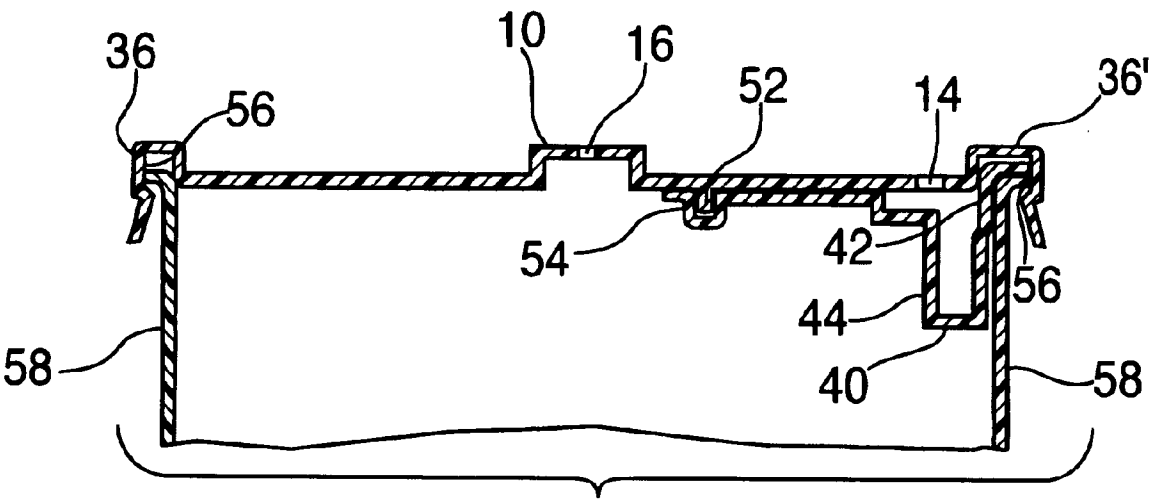

As seen in FIGS. 5A–5B, disc 10 is coplanar such that top portion 19 of chamber 18 is coplanar with disc 10. Drinking hole 14 is positioned in top portion 19 of chamber 18.

Additionally, as shown in FIGS. 5A–5B, bottom section 30 is a separate piece from disc 10. The embodiment shown in FIGS. 5A–5B, the two pieces, disc 10 and bottom section 30, are separately molded or, alternatively, have been molded together but have been separated from each other. Additionally, arched side 32 has no snap fitting periphery 34 but, rather, flange 34' that fits into snap fitting periphery 36'. Snap fitting periphery 36' is designed to accommodate flange 34'.

Turning to FIGS. 6–9, alternative embodiments of bottom section 30 and chamber 18 are shown.

Figure 6:
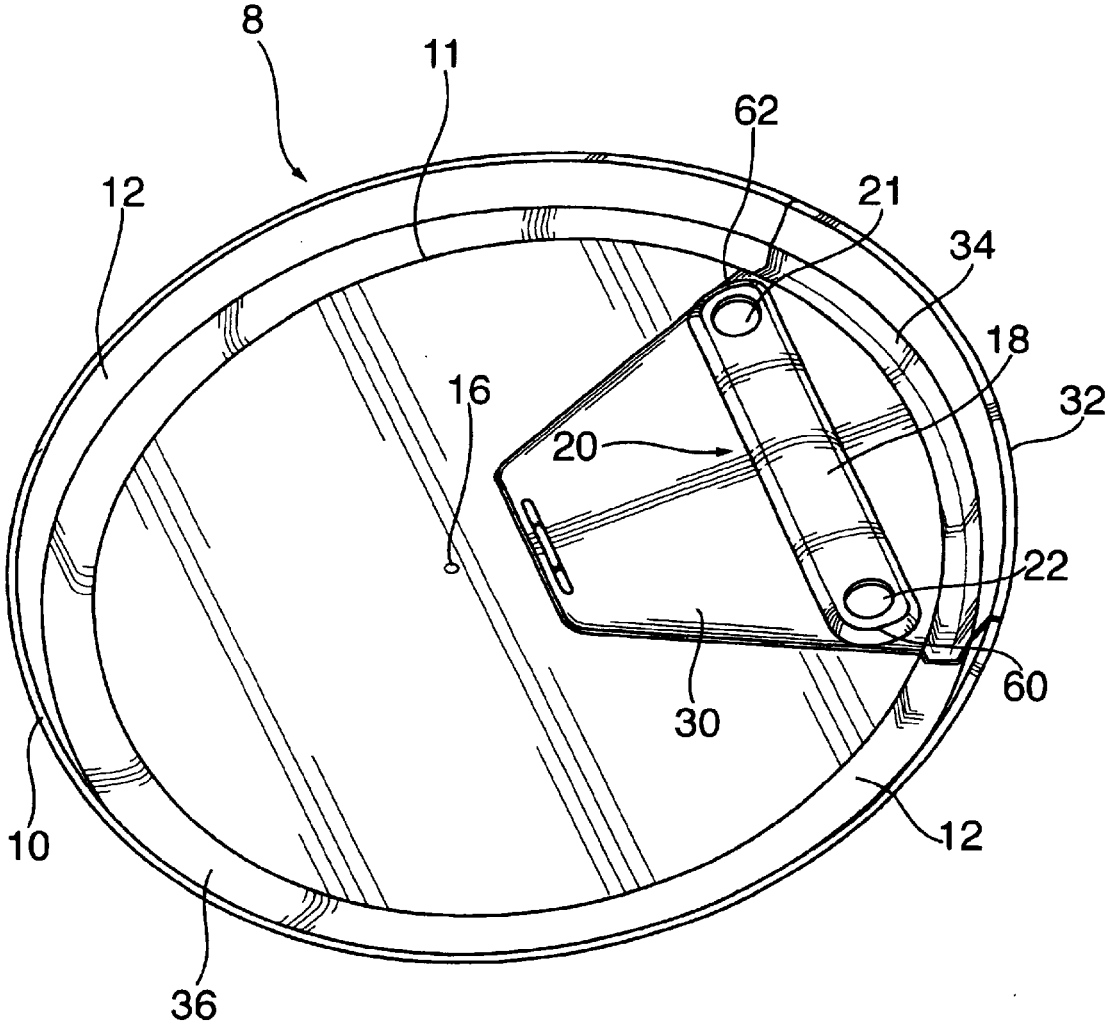
FIG. 6 is a perspective bottom view of another design for the chamber portion.

In FIG. 6, the bottom portion of chamber 18 is shown as a straight tube.

Figure 7:
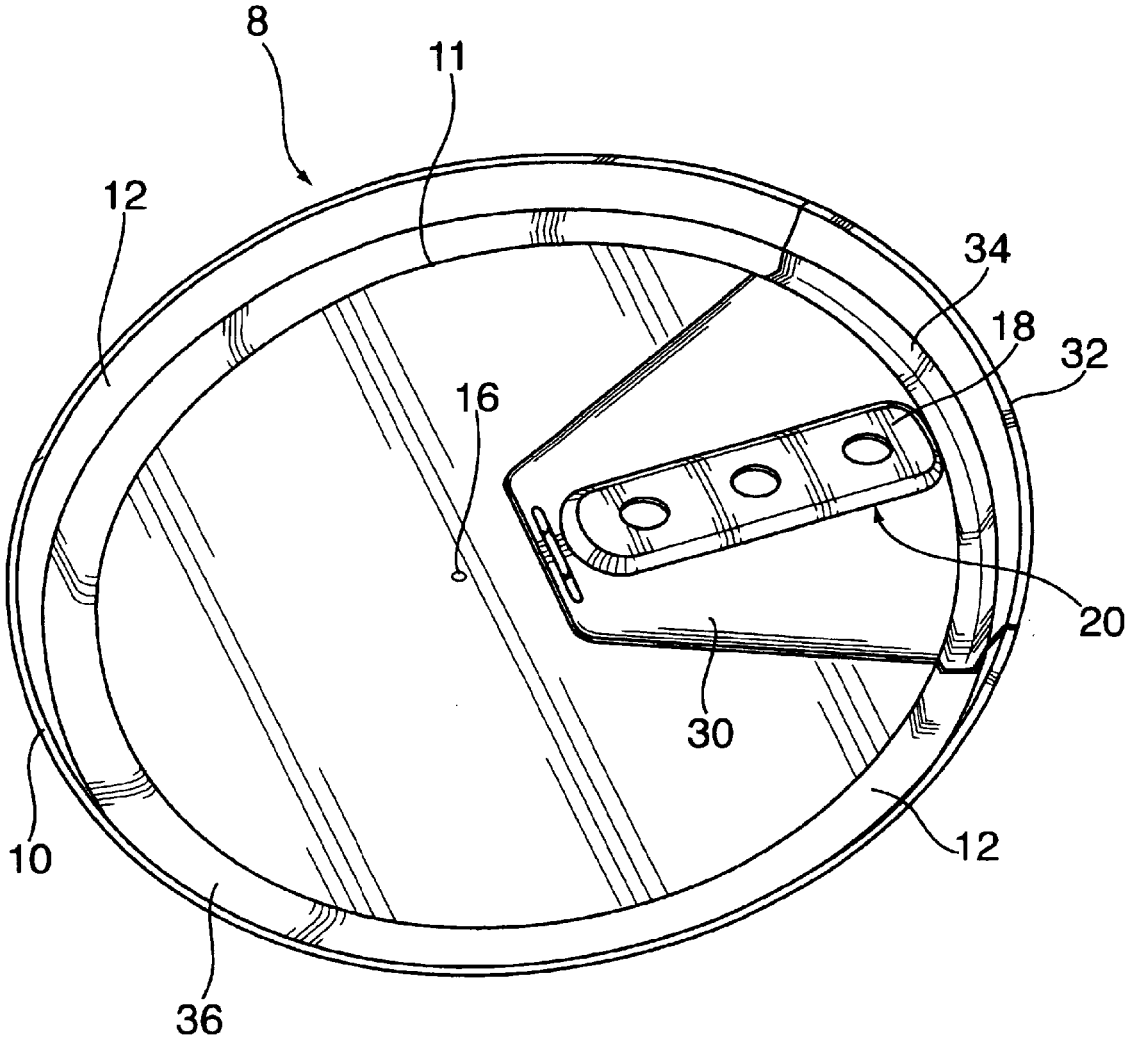
FIG. 7 illustrates a perspective bottom view of another embodiment of the chamber portion of the present invention.

In FIG. 7, bottom portion 20 of chamber 18 is shown being perpendicular to the periphery of disc 10.

Figure 8:
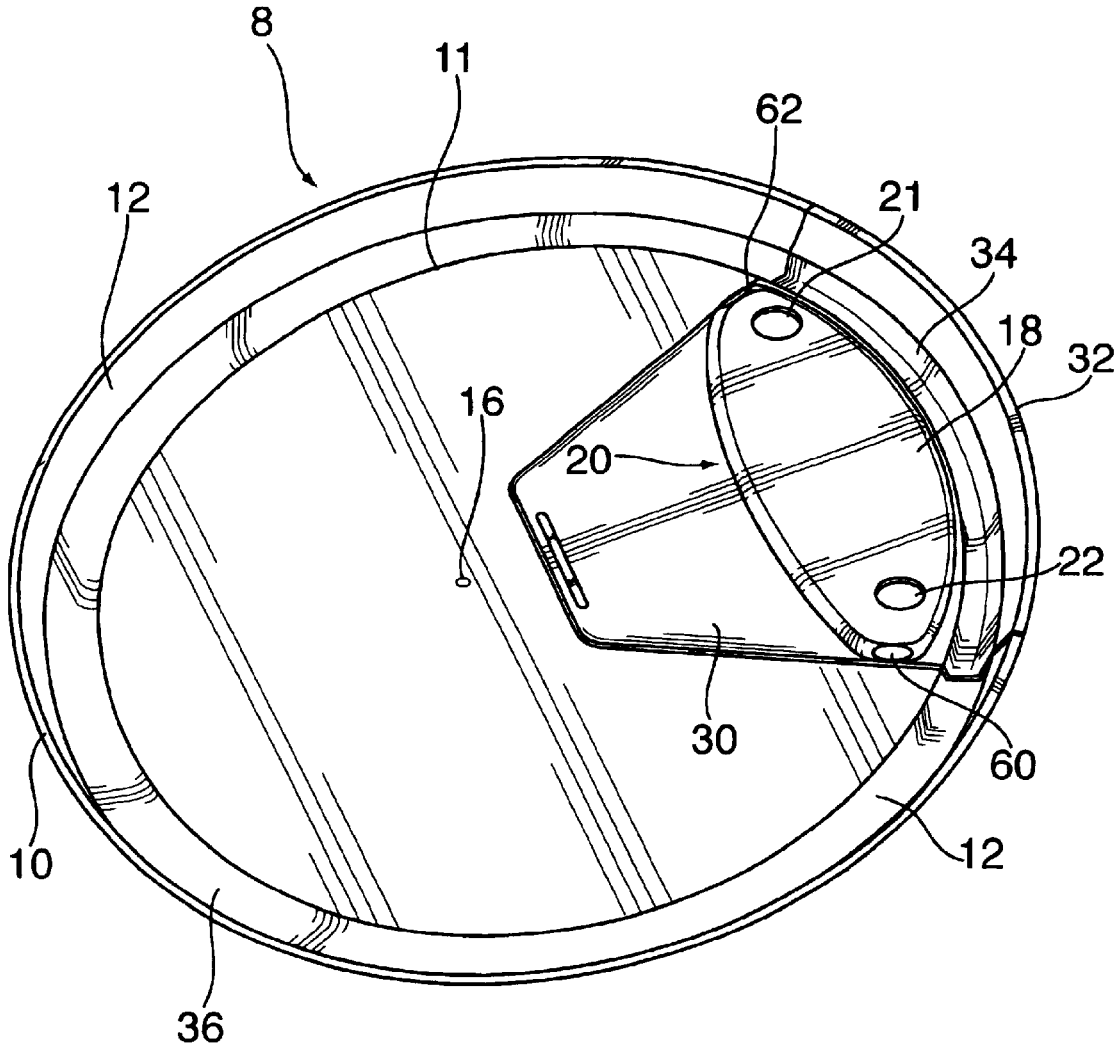
FIG. 8 illustrates a perspective bottom view of yet another chamber design for the lid of the present invention.

In FIG. 8, bottom portion 20 of chamber 18 is illustrated as a pillow.

Figure 9:
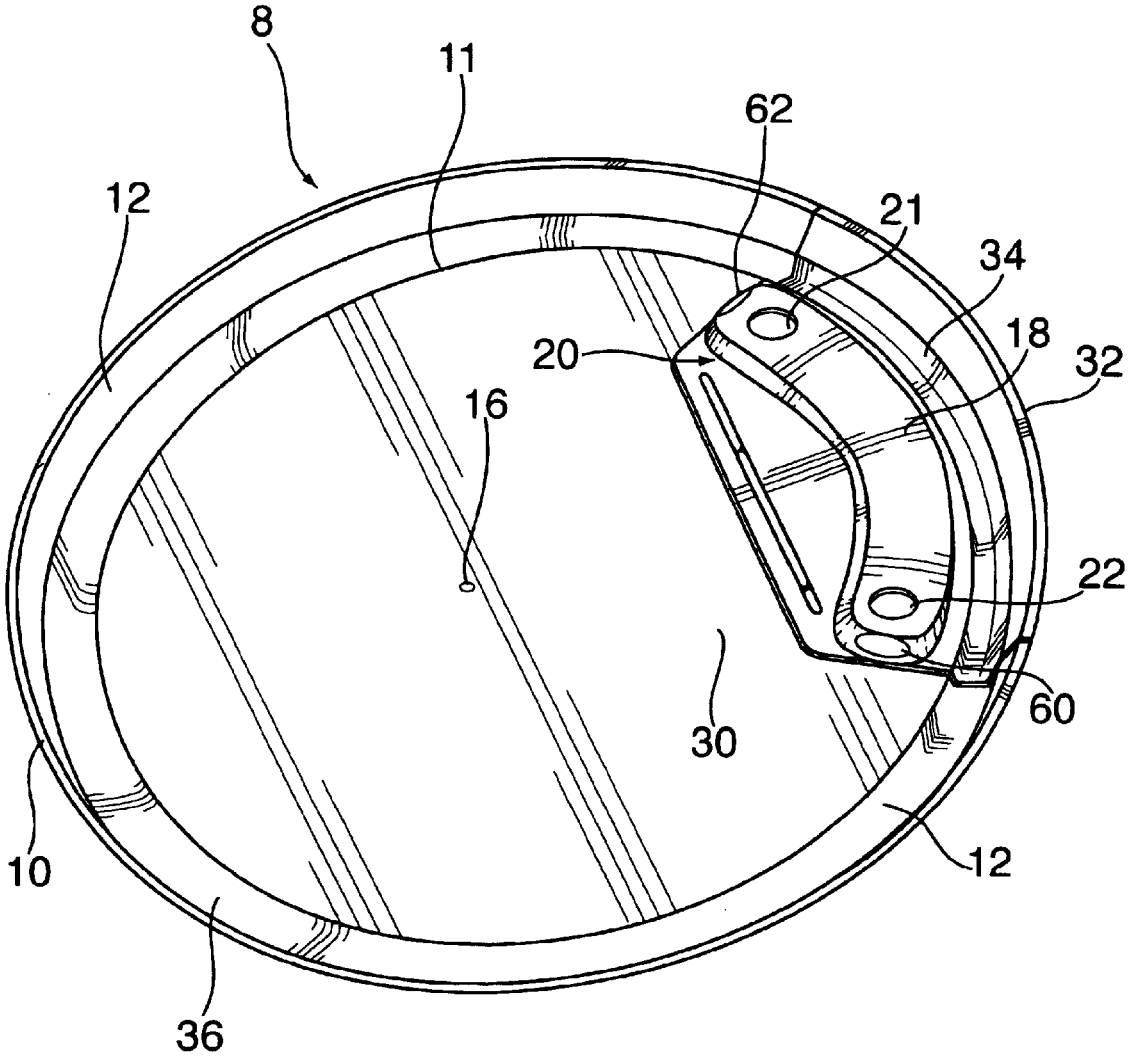
FIG. 9 illustrates a perspective bottom view of another design for the bottom lid section of the present invention.

In FIG. 9, bottom section 30 is shown as not extending all the way to hole 16. It can also be seen that bottom wall 40 of chamber 18 is peaked at the center and slanted towards inlets 21, 22 to allow fluid to run out of chamber 18 when lid 8 is horizontal.

It will be appreciated that top portion 19 is either flat as shown in FIGS. 5A–5B, or is shaped to match bottom portion 20 of chamber 18 as shown in FIGS. 4A–4D.

Figure 10:
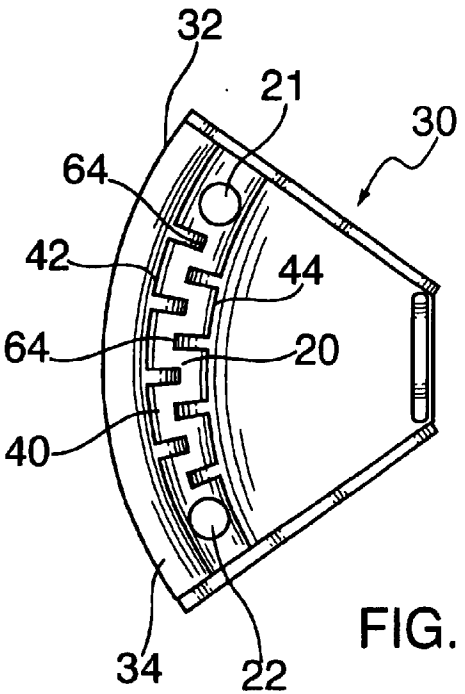
FIG. 10 illustrates a top view of the chamber wherein baffles have been employed.

FIG. 10 illustrates a top view of bottom portion 20 of chamber 18 where chamber 18 has one or more baffles 64 positioned therein. Baffles 64 help to prevent spillage. Baffles 64 extend upward from bottom wall 40 and against lower side walls 42 and 44 as shown. Preferably, the height of baffles 64 are equal to the height of side walls 42 and 44.

It will be understood that the claims are intended to cover all changes and modifications of the preferred embodiments of the invention herein chosen for the purpose of illustration which do not constitute a departure from the spirit and scope of the invention.

What is claimed is:

1. A splash-proof lid for a drinking cup comprising:

a circular disc having a snap fitting periphery for engagement with a cup rim;

an air hole positioned in said disc at the center of said disc;

a drinking hole positioned in said disc adjacent said snap fitting periphery of said disc, said drinking hole being larger than said air hole;

a first engagement means positioned on said disc at the underside of said disc between said snap fitting periphery and said air hole;

a bottom lid section having an arcuate side which mates with a portion of said snap fitting periphery of said disc, and a second engagement means positioned for engaging with said first engagement means when said arcuate side mates with said snap fitting periphery; and a chamber formed between said disc and said bottom lid section when said bottom lid section is placed against the underside of said disc and said first engagement means engages said second engagement means and said arcuate side mates with said portion of said snap fitting periphery, said chamber having a bottom chamber portion which is formed by said bottom lid section and extends below said disc, said chamber being centered on said drinking hole, said drinking hole being in the top of said chamber, said chamber having at least one inlet formed in the bottom chamber portion, said inlet not being in vertical alignment with said drinking hole.

2. The lid of claim 1 wherein said bottom lid section is rotatably attached to said disc along said snap periphery of said disc and said arcuate side of said bottom lid section.

3. The lid of claim 1 wherein said bottom section is separate from said disc until said bottom section is placed against the underside of said disc.

4. The lid of claim 1 wherein said chamber comprises a top chamber portion which is positioned in said disc and extends upwardly from said disc and is centered on said bottom chamber portion, said drinking hole centered in said top chamber portion.

5. The lid of claim 1 wherein said inlet is in a side wall of said bottom chamber portion.

6. The lid of claim 1 wherein said inlet is in a bottom wall of said bottom chamber portion.

7. The lid of claim 1 wherein two or more inlets are formed in said bottom chamber portion.

8. The lid of claim 7 wherein said two or more inlets are in a side wall of said bottom chamber portion.

9. The lid of claim 7 wherein said two or more inlets are in a bottom wall of said bottom chamber portion.

10. The lid of claim 1 wherein said bottom wall of said bottom chamber portion is peaked at its center and slanted downward towards said end walls.

11. The lid of claim 1 wherein said chamber has a top wall formed by said disc and said top wall is coplanar with said disc.

12. The lid of claim 1 wherein said chamber is shaped as an arcuate tube, concentric with said arcuate side of said bottom lid section.

13. A splash-proof lid for a drinking cup comprising:

a circular disc having a snap fitting periphery for engagement with a cup rim;

an air hole in said disc which is positioned in the center of said disc;

an arched tube adjacent said snap fitting periphery, said tube having a center line that follows a radial line that is concentric with the radius of said disc and less than the radius of said disc, said tube having a top portion which is above the top surface of said disc and a bottom portion which is below the bottom surface of said disc;

a drinking hole in a top wall of said tube, said tube centered on said drinking hole, said air hole being smaller than said drinking hole;

at least one inlet in said tube positioned in said bottom portion of said tube such that said inlet is in fluid communication with said drinking hole to allow a user to drink through the lid when the lid is placed on top of a drinking cup; and a bottom section which mates with said circular disc to form said arched tube and to form a portion of said snap fitting periphery.

14. The lid of claim 13 wherein said inlet is in a bottom wall of said tube.

15. The lid of claim 13 wherein said inlet is in an end wall of said bottom portion of said tube.

16. The lid of claim 13 wherein two or more inlets are formed in said bottom portion of said tube.

17. The lid of claim 16 wherein said two or more inlets are in a side wall of said bottom portion of said tube.

18. The lid of claim 16 wherein said two or more inlets are in a bottom wall of said bottom portion of said tube.

19. The lid of claim 13 wherein said bottom wall of said bottom portion of said tube is peaked at its center and slanted downward towards end walls of said tube.

20. The lid of claim 13 wherein said arched tube forms an angle of about 5E to about 90E.

21. The lid of claim 20 wherein aid arched tube forms an angle of about 30E to about 60E.

22. A splash-proof lid assembly for making a lid for use with a drinking cup comprising:

a circular disc having a periphery;

a first snap fitting periphery portion which extends around a first portion of said periphery, said first snap fitting periphery portion being absent from a second portion of said periphery;

a chamber top portion with a drinking hole therein, said chamber top portion positioned adjacent to said periphery at said second portion of said periphery, said chamber top portion rising above the top surface of said disc;

an air hole positioned in the center of said disc;

a bottom section having an arcuate side, said bottom section having a second snap fitting periphery portion which is adjacent said arcuate side and a chamber bottom portion having at least one inlet therein, said chamber bottom portion adjacent said second snap fitting periphery portion, said bottom section rotatably attached to said disc along said periphery of said disc such that when said bottom section is rotated under said disc, said second snap fitting periphery portion is positioned in said second portion of said periphery and said chamber bottom portion aligns with said chamber top portion to form a chamber, said inlet is in fluid communication with said drinking hole, and said first snap fitting periphery portion and said second snap fitting periphery portion for a complete snap fitting periphery of said lid.

23. The splash-proof lid assembly of claim 22 wherein said chamber is an arched-shape tube.

24. The splash-proof lid assembly of claim 22 wherein said disc has a projection and said bottom section has a channel which mates with said projection when said bottom section is rotated to mate with the underside of said disc.

25. The lid assembly of claim 22 wherein said inlet is in a bottom wall of said chamber bottom portion.

26. The lid assembly of claim 22 wherein said inlet is in an end wall of said chamber bottom portion.

27. The lid of claim 22 where two or more inlets are formed in said chamber bottom portion.

28. The lid of claim 27 wherein said two or more inlets are in a side wall of said bottom chamber portion.

29. The lid of claim 27 wherein said two or more inlets are in a bottom wall of said bottom chamber portion.

30. The lid of claim 22 wherein said bottom chamber portion has a bottom wall and end walls, said bottom wall is peaked at its center and slanted downward towards said end walls.

31. A splash-proof lid for a drinking cup comprising:

a disc having a snap fitting periphery for engagement with a cup rim;

a drinking hole in the disc positioned adjacent to the snap fitting periphery;

an air hole in the disc; and an arc capillary tube on a bottom of the disc, the arc capillary tube having a radius which is concentric with a radius of the disc and less than the radius of the disc, the arc capillary tube having at least one inlet opening that is in fluid communication with the drinking hole, said tube is formed by a bottom section that mates with said disc when said bottom section is placed against an underside of said disc, said bottom section having a portion that mates with said snap fitting periphery.

32. The lid of claim 31 wherein said bottom section is rotatably attached to said disc.

33. A splash-proof lid for a drinking cup comprising:

a surface having a snap fitting periphery for engagement with a cup rim;

an air hole in the surface positioned away from the snap fitting periphery; and a tube having a top portion which is above a top of the surface and a bottom portion which is below a bottom of the surface, the tube including a drinking hole in the top portion of the tube and at least one inlet opening in the bottom portion of the tube, such that the at least one inlet opening is in fluid communication with the drinking hole, said tube has an arcuate side which mates with a portion of said snap fitting periphery of said surface.

34. The lid of claim 33 wherein said tube has a center line that follows a radial line that is concentric with the radius of said disc and less than the radius of said disc.

35. A splash-proof lid assembly for making a lid for use with a drinking cup comprising:

a surface having a periphery;

a first snap fitting periphery portion which extends around a first portion of the periphery;

a tube top portion within the surface including a drinking hole; and a bottom section rotatably attached to the periphery of the surface along a second portion of the periphery, the bottom section being shaped to form a tube bottom portion with at least one inlet when the bottom section is rotated under the surface, the tube top portion and the tube bottom portion thereby forming a tube that connects the inlet in fluid communication with the drinking hole.

36. The splash-proof lid assembly of claim 35 wherein said tube has a center line that follows a radial line that is concentric with a radius of said surface and less than the radius of said surface.

* * * * *